United States Patent [19]
Pin-Houng
[11] 4,318,242
[45] Mar. 9, 1982

[54] RAIL TRACK CHASING TOYS

[76] Inventor: Lin Pin-Houng, 1105 Room, 185 Sung-Kang Rd., Taipei, Taiwan

[21] Appl. No.: 165,678

[22] Filed: Jul. 3, 1980

[51] Int. Cl.[3] ..... A63H 17/00; A63H 11/10; A63H 29/16; A63H 11/00

[52] U.S. Cl. ..... 46/44; 46/104; 46/202; 46/264; 46/107

[58] Field of Search ..... 46/44, 106, 107, 251, 46/264, 248, 201, 206, 202, 104; 273/86 B, 85 H

[56] References Cited

U.S. PATENT DOCUMENTS 1,100,031 6/1914 Silver ..... 46/44
1,394,136 10/1921 Ballantine ..... 46/113
3,224,771 12/1965 Altieri ..... 46/206
3,699,711 10/1972 Coffey, Sr. ..... 273/86 B
3,785,085 1/1974 Peroni ..... 46/206

*Primary Examiner*—Gene Mancene
*Assistant Examiner*—Michael J. Foycik

[57] ABSTRACT

The present invention relates to a kind of rail track toy comprising a relatively large self-driven predator that blows a current of air and a relatively small prey driven by the propulsion of the air current, in which the predator is provided with a mechanism which temporarily intercepts said air current in cooperation with the synchronous closure of the previously widely opened mouth of the predator to hold the prey therein, and after a transient interval, stop intercepting said air flow in response to the opening of the mouth to push said prey out to continue the game of chase-and-run.

6 Claims, 5 Drawing Figures

RAIL TRACK CHASING TOYS

BACKGROUND OF THIS INVENTION

Notwithstanding the variety of the present available rail track toys, for example toy model locomotives, and space orbital UFO, etc, which play important roles on the toy markets of developed countries, such toys can merely make monotonous advancing action along a rail track, thus leading to their insipidity and failing to stimulate consumers' interest therefor.

Accordingly, it is the important object of the present invention to provide an improved kind of track toy which offers high amusement.

It is another object of this invention to provide an improved kind of toy which can perform other functions than monotonous advancing motion along a rail track.

SUMMARY

This invention relates to track toys, and more particularly to toys which chase along an endless rail track to enhance the amusement thereof. Basically, this invention comprises two toys, a relatively big one (hereinafter referred to as "predator"), and a relatively small one (hereinafter referred to as "prey"), and a rail track wherealong the two toys perform a chase-and-run game. Preferably, the two toys are so designed as to have the shape of a predator, for example a shark, a tiger, a cat or a toad, etc., and the corresponding prey, for example, a small fish, a rabbit, a mouse or a grasshopper and so forth, in nature. The prey, light in weight and without driving means of itself, is propelled to move along the rail track by the thrust of an air jet breathed by the predator following closely behind. The predator is self driven and provided with a bi-axle motor the functions of which not only include driving the toy and the fan, but also include controlling the shutting of the mouth of the predator and changing the flow rate of the air jet therefrom. By means of the thrust of the air jet from the predator the prey is propelled to run along the rail track, thus forming a scene of chase-and-run. When air is ejected from the mouth of the predator steadily, in other words, the flow rate remains contant, the distance between the two toys is kept nearly the same, although it may slightly shortened or lengthened at a turning point due to the transient slowdown of either toy. However, when the air jet supply weakens, or even completely stops, the prey is no longer pushed, and therefore slows down and is caught up by the fierce predator and enters the latter's mouth which is always widely opened in chasing. No sooner has the prey entered the predator's mouth then the device controlling the opening and closing of the predator's mouth starts to operate so that the prey may be held in the former's mouth as if it were devoured. Then the air jet recovers, and simultaneously the mouth of the predator opens, thereby spitting the prey out to continue another round of the chase-and-run game.

Numerous other features, objects, and advantages of the invention will become apparent from the following specification when read in connection with the accompanying drawing in which;

DETAILED DESCRIPTION OF PREFERRED EMBODIMENTS

Figure 1:
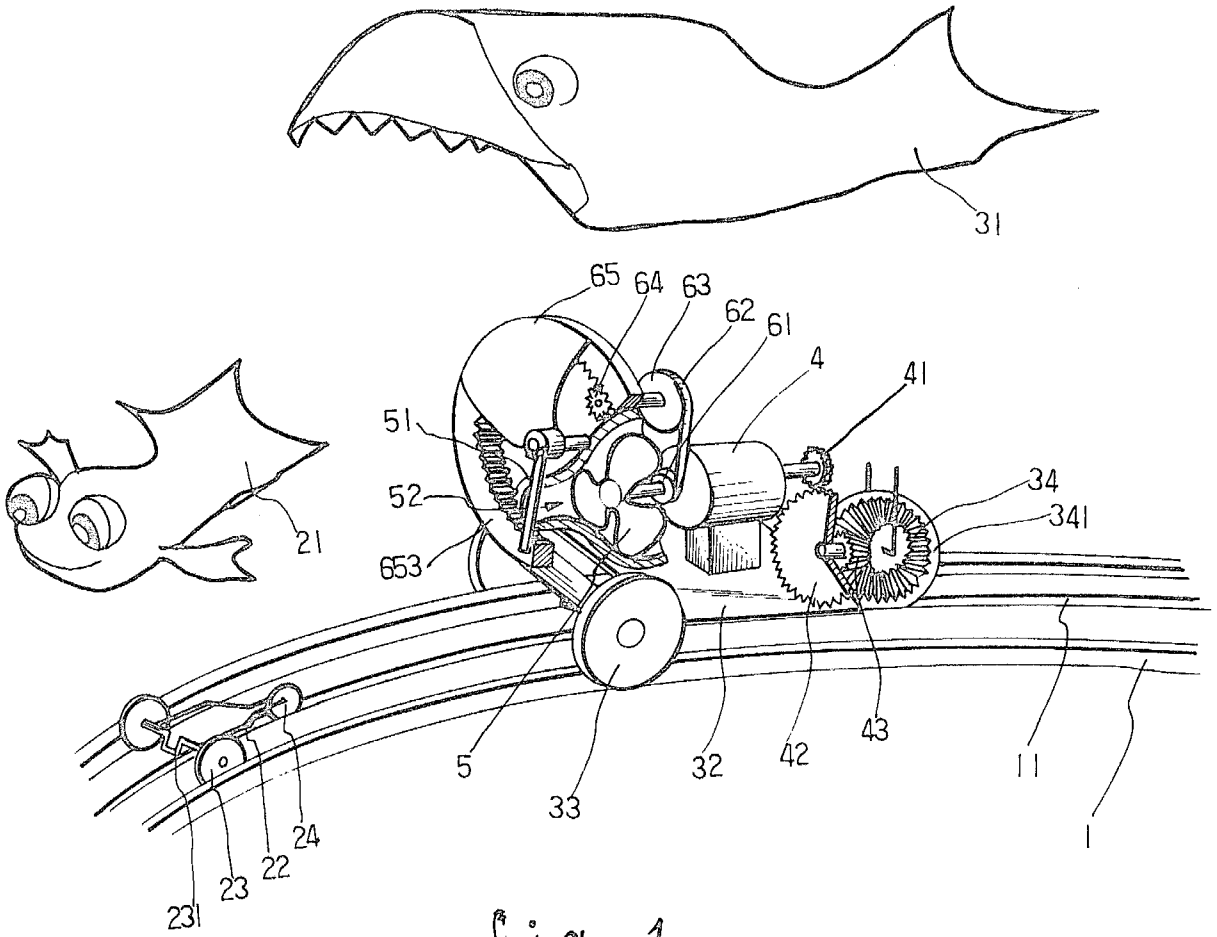
FIG. 1 is a perspective view of the present invention showing two de-mantled toys chasing and running on a rail track.
Figure 2:
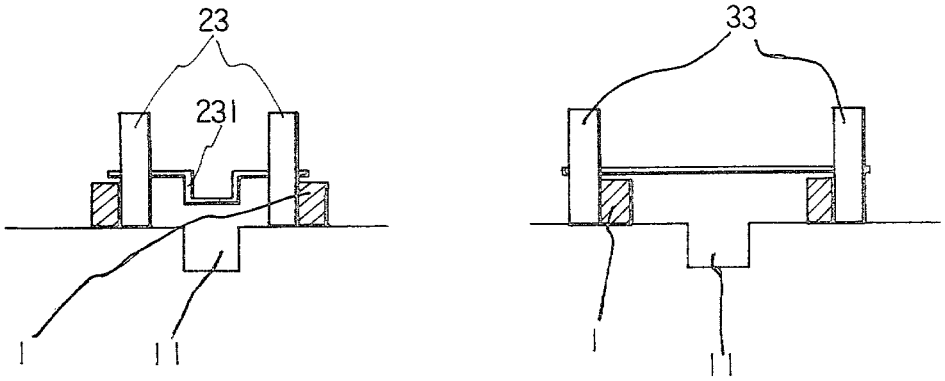
FIG. 2 is a graphical representation showing the contact between the two co-axial wheels of both toys; and the rail track.
Figure 3:
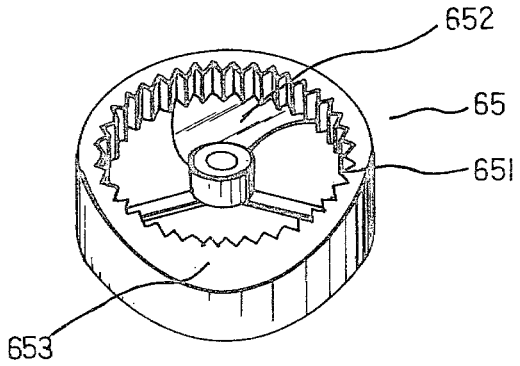
FIG. 3 is a perspective view of the planetary gear wheel provided with a foil and a cam rim.

With reference now to the drawing, particularly FIG. 1 thereof, both the predator and prey are basically composed of two main portions: a body, and a chassis. The bodies (21) (31) of both toys are removed to expose the chassis (22) (32) running along the rail track (1). Preferably, the prey has a broad, sagitally flattened rear portion in order to receive more propellent from the predator and to facilitate the prey to be encased completely in the predator. The two front wheels of the former are preferably designed to roll along the outside of the two rails of rail track (1), whereas that of the latter, the inside thereof. (See FIG. 2). The front axle of the prey can be designed to form a mechanism which changes rotation into linear motion to cause the frequent blink of the eyes, the alternate opening and shutting of the mouth or the flap of wings or fins when it is running, thereby making it more lifelike. Since such devices are well known in the art, they are not illustrated in the drawing.

In this preferred embodiment, each of the predator and the prey has only one rear wheel (24, 34). To make their motion more smoothly and stable, there is provided a guide groove (11) between the two rails wherein the rear wheel of each toy follows.

As the two front wheel of the predator yield a larger difference of speed in turning than do that of the prey, they are preferably so designed as to be allowed to rotate indepently about a fixed front axle to avoid the danger of derailment or sideway upset at a turning point.

The following embodiment will be helpful for understanding the construction of the present invention. However the preferred embodiment demonstrates the feasibility of this invention only, and is not restrictive thereof.

Figures 4, 5:
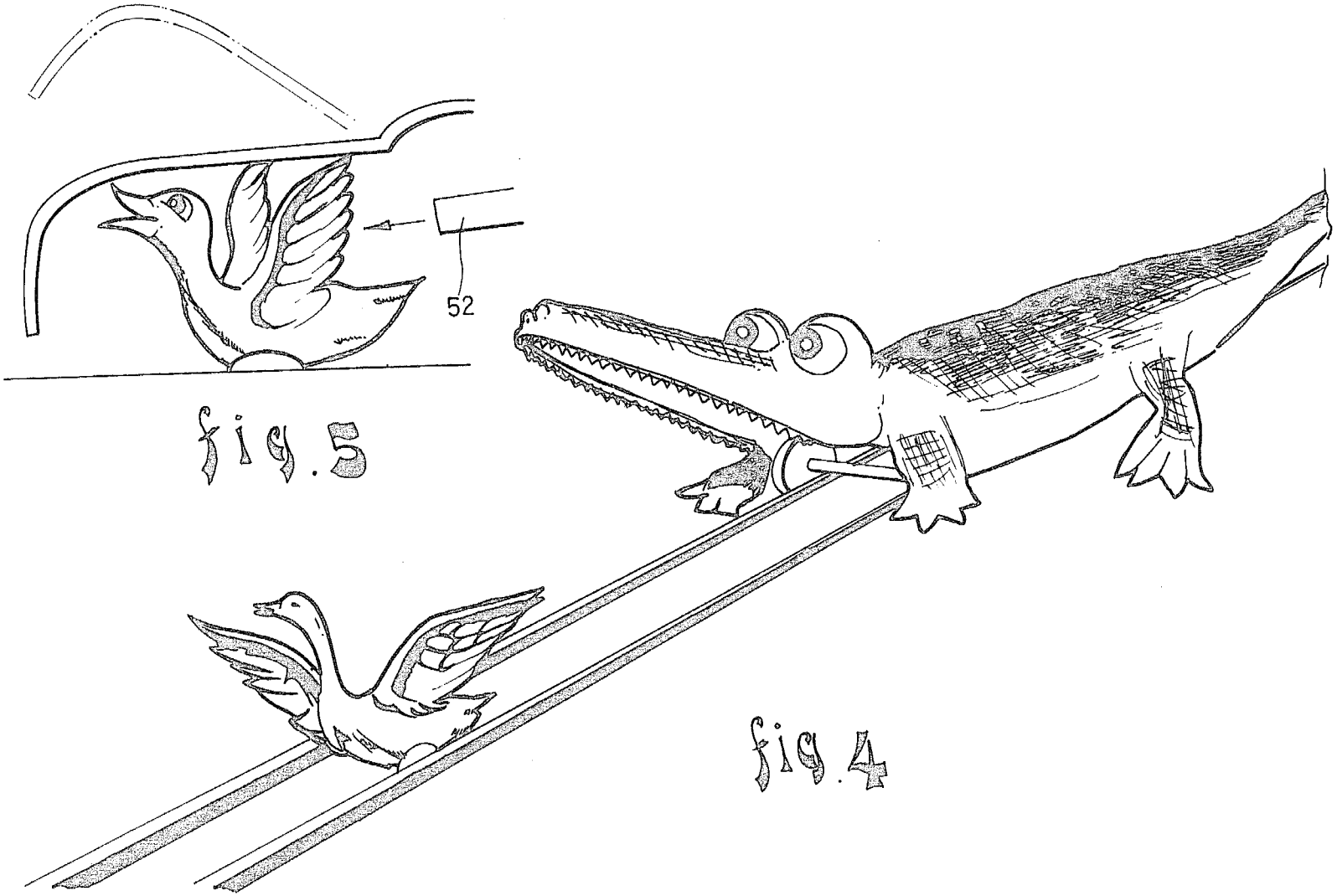
FIG. 4 is an embodiment according to this invention.
FIG. 5 is a graphical representation showing a prey held in the mouth of a predator.

The bishaft driving motor (4), either energized by dry cells carried by the predator, or powered by a conductive rail track in electrical connection with an electric source which provides the requisite electricity, has a shaft extending in two opposite directions, the rear part of which shaft (hereinafter referred to as rear shaft) transmits the rotation through a train of spur gears (41) (42) to a bevel gear (43) to drive the rear wheel (34) provided with bevel ring toothing (341) on one side with which said bevel gear (43) engages. The front part of said shaft (hereinafter referred to as front shaft) is provided with a fan on its end, thereby producing a stream of air flow which is further converged by a hopper-like neck (51) and passes through the nozzle (52) thereof to propel the light prey ahead of it. A transmission means of the front shaft, for example a small pulley (61) passed over by belt (62) transmits the motion of the motor to a large pulley (63) for speed reducing purpose, which large pulley is mounted together with a small pinion gear (64) coaxially on a shaft, which pinion gear (64) meshes with a planetary wheel-like internal gear (65) provided with one or more spokes (651), and a shutter (652) both interconnecting the boss and the rim thereof, and a cam-edge (653) in position relative to said shutter (652). With the speed reduction of the aforesaid transmission mechanism, the internal gear is thus spun slowly and causes the revolution of said shutter (652) and cam-edge. When the shutter (652) approaches the position of the neck (51), a nozzle (52) is gradually closed until completely blocked with the corresponding the flow rate decreasing to zero. As a result, the prey is no more propelled by any external action now, therefore slowing down, and being caught up by the following predator and held in the mouth thereof. Simultaneously, the cam-edge (653) reaches a specific position to push a follower connecting with a mechanism (not shown in the drawing) which effects to lower the upper jaw of the predator which is lifted high (See FIG. 5). Hence it seems as if the voracious predator swallowed its victim entirely with a single bite. After a transient while, the shutter leaves the nozzle and no longer shields it so that the air flow recovers. Meanwhile the cam-edge no more contacts with the follower. Thus the predator opens its mouth and spits out the once swallowed prey and continues the chase-and-run game.

The above embodiment only aids to illustrate this invention, but does not limit the domain thereof. For example, the bevel gear train which transmits the motion to drive the rear wheel of the predator can be replaced by a worm and gear to obtain a like satisfactory result. Also the motor can be mounted with its rotary shaft perpendicular to the direction in which the predator advances, although longitudinal positioning is more preferred. However the mouth cavity of the predator, i.e the free space enclosed by the openable upper jaw thereof, must be spacious enough to receive the entire prey. The reason why the prey's wheel runs along the inner sides of the rails in contrast with the predator's running the outer sides thereof, and the driving wheel is preferably the rear wheel, is to facilitate the prey to be encased by the predator. An additional function of the fan is that it causes the circulation of the air inside the body which can effectively remove a considerable amount of the heat produced in running, thereby prolinging the allowable time of the game.

The bodies of both predator and prey, are preferably so designed that they can be mounted onto, or dismounted from their respective chassis readily and conveniently, thus allowing the players to replace the kinds of predators and corresponding preys to enhance the amusement of the game.

It is evident that those skilled in this art may now make numerous uses and modifications of and departures from the specific embodiments described herein without departures from the specific invention concepts. Consequently, the invention is to be construed as embracing each and every novel feature and novel combination of features present in or possessed by the apparatus and techniques herein disclosed and limited solely by the spirit and scope of the appended claims.

What is claimed are:

1. A set of rail track chasing toys comprising a relatively large toy (hereinafter referred to as predator) having a mouth movable between an open and a closed position and being normally open, a relatively small, light toy (hereinafter referred to as prey), an endless rail track on which the predator and prey are placed with the predator disposed behind the prey, means on said predator and prey to enable them to run along said track, means on said predator operable to drive same along said track, said predator being provided with means to produce an airflow having a thrust directed at said prey and sufficient to propel said prey along said track whereby said predator can chase said prey along said track, means on said predator for interrupting said airflow periodically for a definite interval so that the prey may slow down and allow said predator to approach said prey so that the latter enters the open mouth of the predator, and means for moving the predator's mouth to the closed position after said prey enters therein and to the open position after said interval, said airflow resuming after said interval and being operable to push the prey out of the predator's mouth, whereby the predator can continue to chase said prey.

2. A set of rail track chasing toys according to claim 1, wherein the means to drive said predator comprises a driving motor, a driving wheel, and transmission mechanism between said motor and wheel.

3. A set of rail track chasing toys according to claim 1 or 2, wherein the means for moving the predator's mouth to the closed position is operated immediately after the airflow is completely cut off.

4. A set of rail track chasing toys according to claim 2, wherein said means to produce said airflow comprises a fan driven by said motor, and there is provided a convergent nozzle through which said air flow is passed towards said prey.

5. A set of rail track chasing toys according to claim 2, wherein said means for interrupting said airflow comprises a shutter mounted on an internal gear which meshes with a speed reducing transmission mechanism driven by said motor, said shutter temporarily interrupting said airflow when said internal gear is turned to a definite position.

6. A set of rail track chasing toys according to claim 5, wherein said means for moving the predator's mouth to the closed and open position comprises a cam on the outer edge of said internal gear which actuates a mechanism for depressing and lifting said mouth, said cam being so shaped and positioned so as to start functioning when said shutter completely cuts off said airflow and to stop functioning when said shutter no longer shields said airflow.

* * * * *